US007621752B2

(12) United States Patent
Lin et al.

(10) Patent No.: US 7,621,752 B2
(45) Date of Patent: Nov. 24, 2009

(54) LED INTERCONNECTION INTEGRATED CONNECTOR HOLDER PACKAGE

(75) Inventors: Jeff C. Lin, Novi, MI (US); Viren B. Merchant, Canton, MI (US); Edwin Mitchell Sayers, Saline, MI (US); Andrew Z. Glovatsky, Plymouth, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 0 days.

(21) Appl. No.: 11/778,945

(22) Filed: Jul. 17, 2007

(65) Prior Publication Data

US 2009/0023323 A1 Jan. 22, 2009

(51) Int. Cl.
*H01R 12/00* (2006.01)

(52) U.S. Cl. ..... 439/56; 439/699.2

(58) Field of Classification Search ..... 439/56, 439/699.2, 557, 558, 488, 490; 362/800, 362/252

See application file for complete search history.

(56) References Cited

U.S. PATENT DOCUMENTS

| | | | | |
|---|---|---|---|---|
| 4,247,864 | A | 1/1981 | Lockard | |
| 4,353,109 | A * | 10/1982 | Weber | 362/13 |
| 4,573,754 | A * | 3/1986 | Hill | 439/280 |
| 4,631,651 | A * | 12/1986 | Bergin et al. | 362/267 |
| 4,864,370 | A | 9/1989 | Gaw et al. | |
| 4,958,429 | A * | 9/1990 | Forish et al. | 29/877 |
| 4,959,761 | A | 9/1990 | Critelli et al. | |
| 4,990,971 | A | 2/1991 | Le Creff | |
| 5,073,806 | A | 12/1991 | Idei | |
| 5,617,131 | A | 4/1997 | Murano et al. | |
| 5,800,183 | A * | 9/1998 | Paul et al. | 439/56 |
| 5,886,401 | A | 3/1999 | Liu | |
| 6,270,355 | B1 * | 8/2001 | Kihara | 439/56 |
| 6,583,444 | B2 | 6/2003 | Fjelstad | |
| 6,682,211 | B2 | 1/2004 | English et al. | |
| 6,707,069 | B2 | 3/2004 | Song et al. | |

(Continued)

FOREIGN PATENT DOCUMENTS

| | | |
|---|---|---|
| JP | 54-37697 | 10/1980 |

(Continued)

OTHER PUBLICATIONS

Office Action mailed Apr. 1, 2008 for U.S. Appl. No. 11/686,101, filed Mar. 14, 2007.

(Continued)

*Primary Examiner*—Hien Vu
(74) *Attorney, Agent, or Firm*—Brinks Hofer Gilson & Lione

(57) ABSTRACT

Disclosed is an LED package holder for retaining and electrically connecting an LED package. The LED package holder includes a housing configured to hold an LED package and has at least one center opening defined therein. A connector shroud is integrally formed with the housing and has a cavity for receiving a connector operable to supply power to the LED package. Two contact features are retained by the housing, and each contact feature has an inner contact and an outer contact. Each inner contact engages an LED electric terminal of the LED package. Each outer contact extends into the connector shroud so as to engage connector terminals when a connector is inserted into the connector shroud.

14 Claims, 4 Drawing Sheets

U.S. PATENT DOCUMENTS

| | | | | |
|---|---|---|---|---|
| 6,733,711 | B2 | 5/2004 | Durocher et al. | |
| 6,840,776 | B2 * | 1/2005 | Sørensen et al. | 439/56 |
| 6,911,731 | B2 | 6/2005 | Wu | |
| 7,019,335 | B2 | 3/2006 | Suenaga | |
| 7,026,660 | B2 | 4/2006 | Guenther et al. | |
| 7,045,905 | B2 | 5/2006 | Nakashima | |
| 7,053,416 | B2 | 5/2006 | Yasuoka et al. | |
| 7,070,418 | B1 * | 7/2006 | Wang | 439/56 |
| 7,083,305 | B2 | 8/2006 | Galli | |
| 7,095,101 | B2 | 8/2006 | Wu | |
| 7,098,588 | B2 | 8/2006 | Jager et al. | |
| 7,150,553 | B2 | 12/2006 | English et al. | |
| 7,161,189 | B2 | 1/2007 | Wu | |
| 7,186,010 | B2 | 3/2007 | Coushaine et al. | |
| 7,255,823 | B1 | 8/2007 | Guenther et al. | |
| 7,322,828 | B1 * | 1/2008 | Chiang | 439/56 |
| 2004/0000727 | A1 | 1/2004 | Hsu | |
| 2004/0175189 | A1 | 9/2004 | Weber-Rabsilber et al. | |
| 2004/0222433 | A1 | 11/2004 | Mazzochette et al. | |
| 2004/0227146 | A1 | 11/2004 | Wu | |
| 2004/0240229 | A1 | 12/2004 | Blumel et al. | |
| 2005/0047157 | A1 | 3/2005 | Reiss | |
| 2005/0205889 | A1 | 9/2005 | Chen | |
| 2005/0239342 | A1 * | 10/2005 | Moriyama et al. | 439/699.2 |
| 2005/0269589 | A1 | 12/2005 | Wu | |
| 2006/0002110 | A1 * | 1/2006 | Dowling et al. | 362/252 |
| 2006/0040566 | A1 * | 2/2006 | Thomas et al. | 439/699.2 |
| 2006/0043401 | A1 | 3/2006 | Lee et al. | |
| 2006/0049420 | A1 | 3/2006 | Liu | |
| 2006/0060881 | A1 | 3/2006 | Anderlini | |
| 2006/0076572 | A1 | 4/2006 | Huber et al. | |
| 2006/0097277 | A1 | 5/2006 | Yoo | |
| 2006/0138436 | A1 | 6/2006 | Chen et al. | |
| 2006/0138441 | A1 | 6/2006 | Kromotis et al. | |
| 2006/0145180 | A1 | 7/2006 | Galli | |
| 2006/0226774 | A1 | 10/2006 | Sofue et al. | |
| 2006/0249744 | A1 | 11/2006 | Kim et al. | |
| 2006/0273339 | A1 | 12/2006 | Steigerwald et al. | |
| 2006/0279949 | A1 | 12/2006 | Shin et al. | |
| 2007/0057271 | A1 | 3/2007 | Schiaffino et al. | |
| 2007/0057665 | A1 | 3/2007 | Borst et al. | |

FOREIGN PATENT DOCUMENTS

| | | |
|---|---|---|
| JP | 1-239528 | 9/1989 |
| JP | 4-141623 | 5/1992 |
| JP | 4-212931 | 8/1992 |
| JP | 6-167715 | 6/1994 |
| JP | 8-160462 | 6/1999 |
| JP | 11-167107 | 6/1999 |
| JP | 11-337931 | 12/1999 |
| JP | 2000-352710 | 12/2000 |

OTHER PUBLICATIONS

Nichia Corporation, Technical Specification entitled "Thermal Management Design of LEDs";Oct. 31, 2003; http://www.nichia.co.jp/product/led_top.html.

Nichia Corporation, Technical Specification entitled "Thermal Management Design of LEDs";Oct. 31, 2003; http://www.nichia.co.jp/product/led_top.html.

Andreas Stich et al, OSRAM Opto Semiconductors, *Thermal Management of OSTAR® Projection Light Source*, Jan. 2006, pp. 1-16.

Andreas Stich et al, OSRAM Opto Semiconductors, *OSTAR®—Lighting*, May 2006, pp. 1-15.

Andreas Stich et al, OSRAM Opto Semiconductors, *Mounting Guideline for High Power Light Sources of the OSTAR® LED Product Family*, May 2006, pp. 1-4.

* cited by examiner

LED INTERCONNECTION INTEGRATED CONNECTOR HOLDER PACKAGE

BACKGROUND

1. Field of the Invention

The present invention generally relates to light-emitting diode (LED) packaging. More specifically, the invention relates to LED packaging for motor vehicle headlamp and other applications.

2. Description of Related Art

An LED is one type of semiconductor that generates light when voltage is applied to it. There are various advantages to using LEDs in vehicle headlamp applications, such as long lifetime, low drive voltage, high vibration resistance, and high tolerance to repeated power switching.

An LED is typically provided in an LED package that provides optics for the LED, such as a dome, and LED terminals for electrical connection. The LED terminals are typically provided having one of several variations, such as gull leads or flat terminal strips. In vehicle headlamp applications, typical methods of providing electrical connection to LED packages include soldering the LED terminals to a printed wiring board, utilizing a wave soldering or reflow process, and/or crimping the LED terminals to wiring. Typically, an LED package is first connected to a printed wiring board or a T-Clad, and then secondarily, the printed wiring board or T-Clad utilizes another electrical connection, such as a header or board connector, for outer interconnection within a circuit. These types of LED terminal connections may not be robust because, without also having mechanical interlocking features, the connections may separate. In addition, the installation process may be costly due to material costs for multiple interconnection processes. The installation process may also be open to error because the installer must undertake multiple steps, some of which may require a high amount of precision.

SUMMARY

In satisfying the above need, as well as overcoming the enumerated drawbacks and other limitations of the related art, the present invention provides an LED package holder that provides an electrical interconnection to an LED package. This interconnection to LED package is in a manner that is less costly and less open to error than soldering to printed wiring boards or T-Clads and wiring crimping.

An LED package holder is provided to hold and electrically connect an LED, within a circuit or to a power source. The holder includes a housing that has at least one center cavity defined therein and which is configured to hold at least one LED package. A connector shroud is integrally formed with the housing and has an cavity for receiving a connector that is operable to supply power to the LED package. A plurality of contact features is retained by the housing. Each contact feature has an inner contact and an outer contact. Each inner contact is configured to engage, or contact, an LED electric terminal of an LED package being held by the housing. Each outer contact extends into the connector shroud and is configured to contact connector terminals when a connector is inserted into the connector shroud.

In another aspect, an LED lighting package is provided. The lighting package includes at least one LED package and an LED package holder. The LED package holder includes a housing with at least one center opening defined therein and into which the LED package is disposed. A connector shroud is integrally formed with the housing and has a cavity for receiving a connector operable to supply power to the LED package. The LED package holder also has a plurality of contact features that are retained by the housing. Each contact feature has an inner contact and an outer contact. Each inner contact engages an electric terminal of the LED package. Each outer contact extends into the connector shroud and is configured to engage connector terminals when a connector is inserted into the connector shroud.

In another aspect, a method of manufacturing a system of LED package holders is provided. The method includes forming a plurality of contact feature sets from a continuous reel, the contact feature sets being connected to each other, and injection molding a housing over each of the contact feature sets. Each housing is injection molded so as to have at least one center cavity defined in a main portion and a connector shroud integrally formed with the housing, wherein each contact feature extends into the main portion and the connector shroud.

Further objects, features and advantages of this invention will become readily apparent to persons skilled in the art after a review of the following description, with reference to the drawings and claims that are appended to and form a part of this specification.

DETAILED DESCRIPTION

Figure 1:
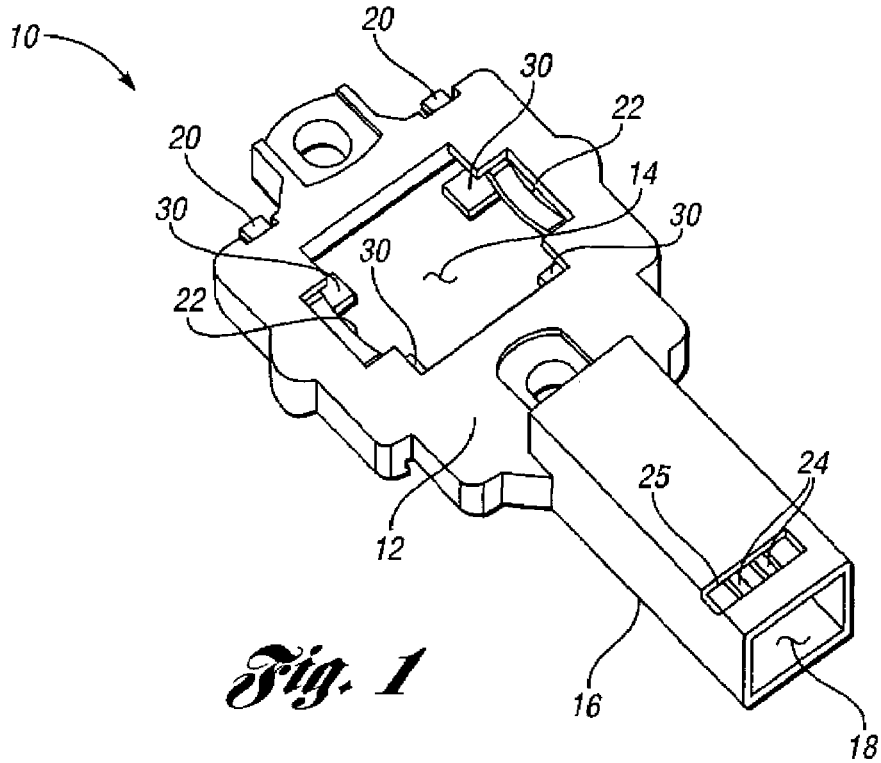
FIG. 1 is a perspective view of an LED package holder embodying the principles of the present invention.
Figure 2:
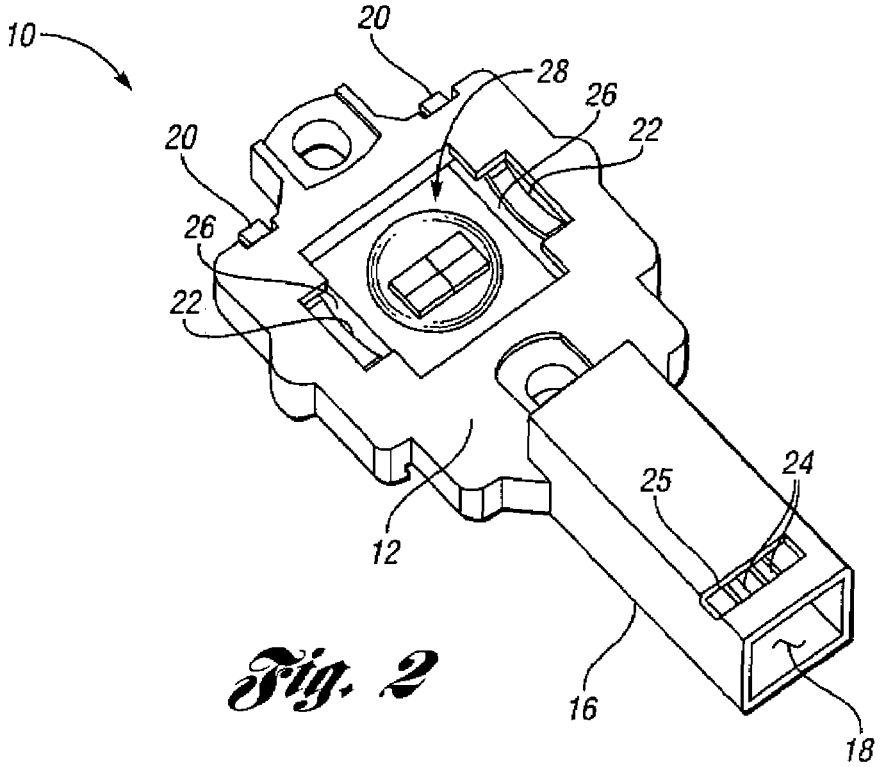
FIG. 2 is a perspective view of a lighting package comprising the LED package holder of FIG. 1.
Figure 3:
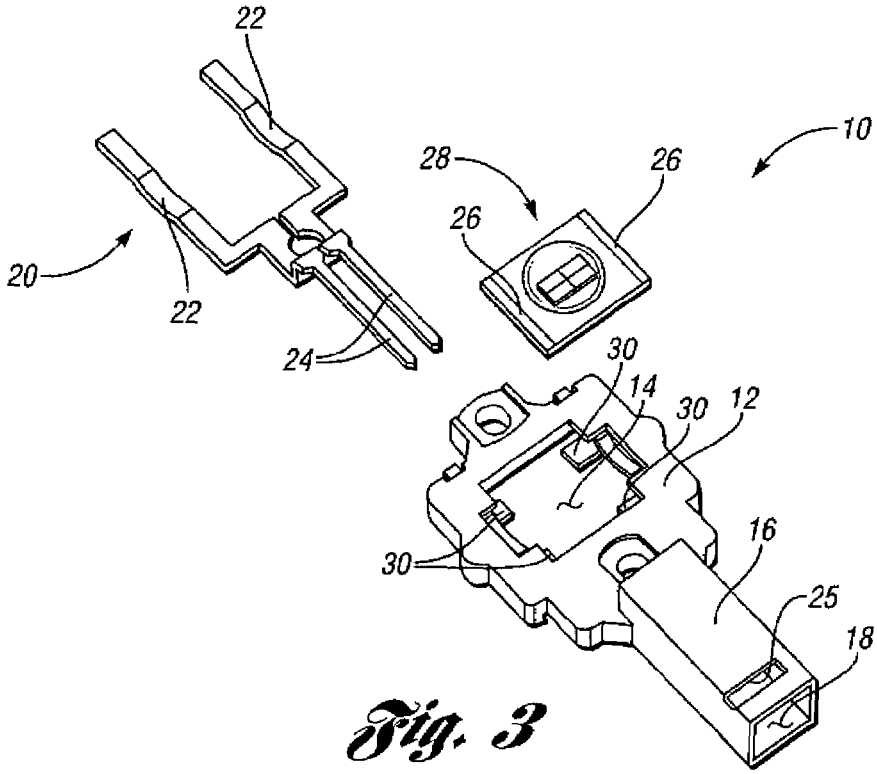
FIG. 3 is an exploded view of the lighting package of FIG. 2.

Referring now to FIGS. 1-3, an LED package holder for holding and electrically connecting an LED is illustrated therein and designated at 10. The holder 10 includes a housing 12 having at least one center cavity 14 defined therein. A connector shroud 16 is integrally formed with housing 12 and has an opening 18 for receiving a connector (not shown).

A plurality of contact features 20 are retained by the housing 12. Each contact feature 20 has an inner contact 22 and an outer contact 24. The inner contact 22 engages the LED terminals 26 of an LED package 28 mounted in the holder 10. LED terminals 26 are shown as flat terminal strips in FIG. 3, but it should be understood that the LED terminals 26 could have other configurations without failing beyond the spirit and scope of the present invention. The outer contact 24 extends into the opening 18 in the connector shroud 16, such that when a connector (not shown) is inserted into the connector shroud 16, an electrical connection between the connector and the outer contacts 24 is established. Thus, electrical power is provided to the LED package 28 via the outer contacts 24. It should be understood that the connector could further connect the LED package 28 within a circuit, rather than directly supplying power to the LED package 28, without falling beyond the spirit and scope of the present invention.

The contact features 20 may be retained by the housing 12 in any suitable manner. For example, the contact features 20 could be in-molded into the housing. Alternatively, the contact features 20 could be mechanically or adhesively retained (snapped, glued, or otherwise attached) to the housing 12.

The connector shroud 16 is preferably configured to mechanically hold a connector in position therein so that the connector is directed to electrically contact the outer contacts 24 of the contact features 20. To this end, the connector shroud 16 and the outer contacts 24 may form a connector receiver with appropriate retention and latching features 25. Further, the connector shroud 16 may form a connector receiver that is a category 0 (0.64 $mm^2$) terminal connector or a category 1 (1.00 $mm^2$) terminal connector. In the alternative, the connector shroud 16 and outer contacts 24 could be configured having a terminal category lower than 0 or higher than 1, such as a terminal category 2, 3, 4, etc. Further, the connector shroud 16 could have any other suitable configuration, without falling beyond the spirit and scope of the present invention. Preferably, the latching features 25 releasably retain a connector to the holder 10, such that the connector may be retained in the connector shroud 16 when in use, but released by a user when desired.

Figure 4:
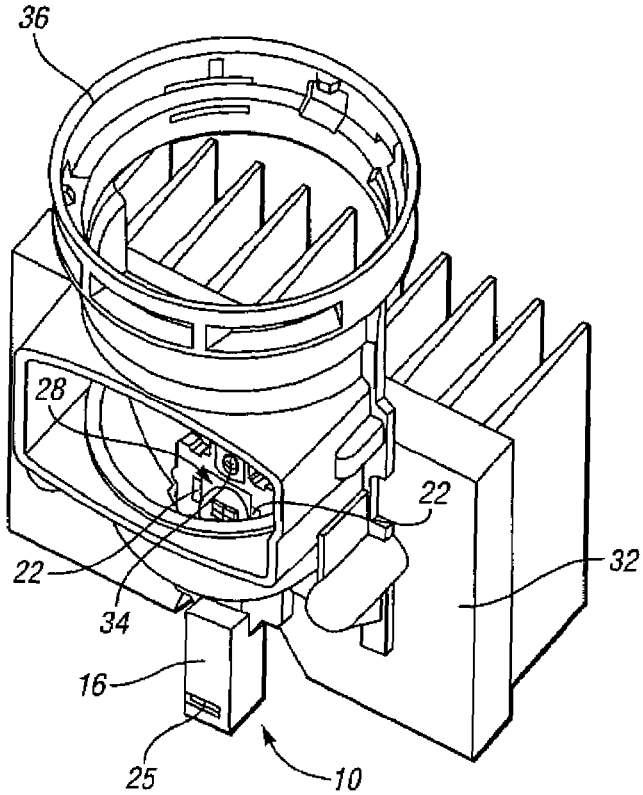
FIG. 4 is a perspective view of a lighting package assembly comprising the lighting package of FIGS. 2-3.

The housing 12 includes latching features 30, or retainers in the form of tabs, to retain the LED package 28 to the housing 12. The latching features 30 are configured to allow the LED package 28 to snap into place, to slide into place, or they may help secure the LED package 28 in any other suitable manner. Alternatively, the latching features 30 could be omitted, and the housing 12 could secure the LED 28 by holding it between the housing 12 and a heat sink (as shown in FIG. 4). The latching features 30 (or retainers or tabs) may be integrally formed with the housing 12 or attached to the housing 12 in any other suitable manner, without falling beyond the spirit and scope of the present invention.

Referring now to FIG. 4, the holder 10 is assembled to a heat sink 32 via screws 34 (or other suitable fastening mechanisms) over an LED package 28. The LED package 28 is secured in place by virtue of it being sandwiched between the holder 10 and the heat sink 32. Thus, the connection between the LED terminals of the LED package 28 and the inner contacts 22 is a spring compression connection, which may be solder-free, if desired. Alternatively, the inner contacts 22 may be connected to the LED terminals with solder, conductive adhesive, welding, or wire bondings, which may be suitable for some applications and some LED packages 28.

In the present embodiment, a light projector 36 is also fastened to the heat sink 32. The light projector 36 may be used with the LED package 28 and holder 10 in an automobile headlamp. As previously discussed, inner contacts 22 electrically connect to the LED package 28 to provide the LED package 28 with power when a connector is inserted into the connector shroud 16.

Figure 5:
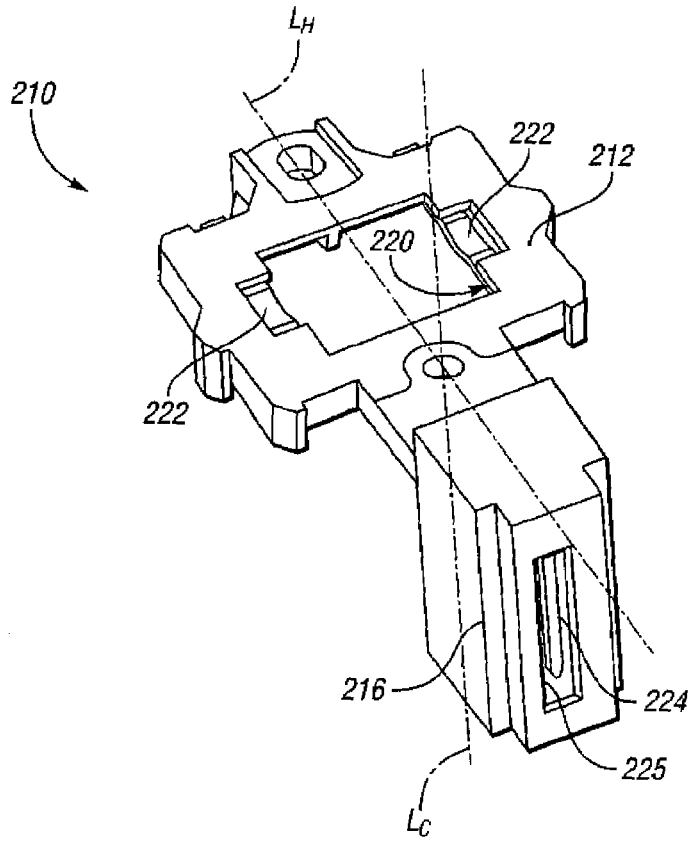
FIG. 5 is a perspective view of another LED package holder embodying the principles of the present invention.

Referring now to FIG. 5, an alternate configuration for a holder 210 of an LED package (not shown) is illustrated. Like the previous LED package holder 10, the LED package holder 210 of FIG. 5 has a housing 212 that is integrally formed with a connector shroud 216 and contact features 220 that include inner contacts 222 and outer contacts 224. In this embodiment, the connector shroud 216 has a latching feature 225 (an opening to receive a biased latching finger) to releasably retain a connector. The connector shroud 216 has a longitudinal axis $L_C$ that is oriented on an angle from the longitudinal axis $L_H$ of the housing 212. The angled connector shroud 216 may be more desirable than a straight configuration for some vehicle headlamp designs. In FIG. 5, the angle between the longitudinal axis $L_H$ of the housing 212 and the longitudinal axis $L_C$ of the connector shroud 216 is shown as being 90°, however, it should be understood that any other suitable angle could be used without falling beyond the spirit and scope of the present invention.

Figure 7A:
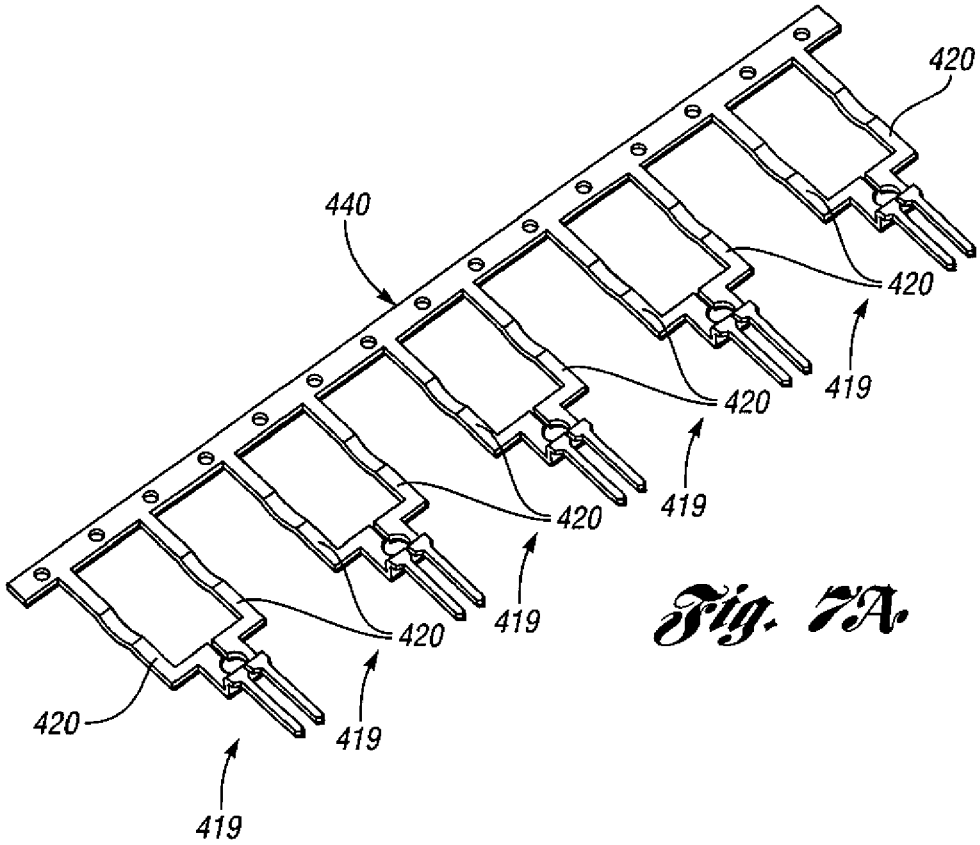
FIG. 7A is a perspective view of a plurality of contact feature sets created by the method of the present invention.

With reference to FIG. 7A, a continuous strip 440 is illustrated. The continuous strip 440 preferably has a plurality of contact features sets 419 extending therefrom; however, it is contemplated that the continuous strip 440 could have merely one contact feature set 419 extending therefrom. Each contact feature set 419 includes a plurality of contact features 420. The continuous strip 440 and contact feature sets 419 are preferably formed by stamping from a continuous reel; however, it is also contemplated that the contact feature sets 419 and continuous strip 440 could be formed continuously by another method. Further, the contact feature sets 419 are shown being formed so as to be connected to each other by the continuous strip 440, however, it is contemplated that the contact feature sets 419 could be formed so as to be connected to each other by means other than a continuous strip 440, without falling beyond the spirit and scope of the present invention. For example, the contact feature sets 419 could be formed so as to be connected to each other by a connecting strip between each contact feature 420.

Figure 7B:
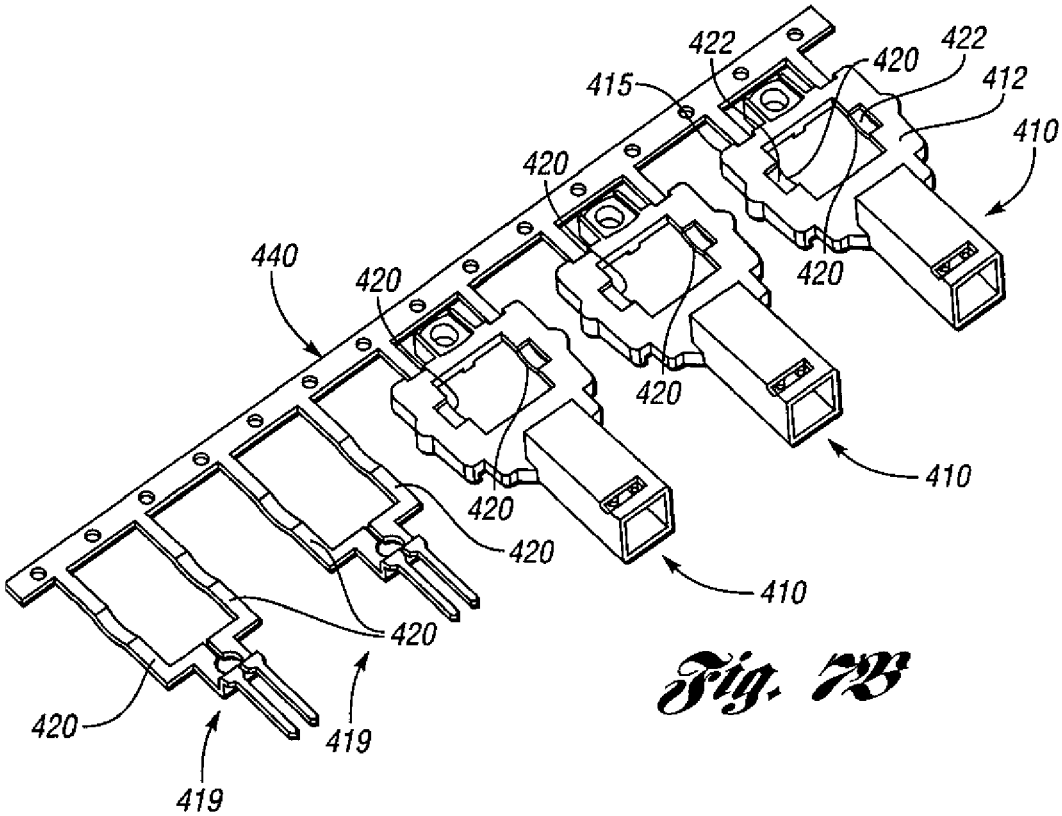
FIG. 7B is a perspective view of a plurality of LED package holders embodying the principles of the present invention and created by the method of the present invention.

With reference to FIG. 7B, a plurality of housings 412 having connector shrouds 416 integrally formed therewith are injection molded over the contact features 420. Preferably, each housing 412 and connector shroud 416 is molded (individually or simultaneously) over one contact feature set 419; however, it is contemplated within in the spirit and scope of the present invention that each housing 412 and connector shroud 416 could be molded over a plurality of contact feature sets 419. After the injection molding process, the continuous strip 440 can be cut, if desired, to separate each LED package holder 410. Further, the continuous strip 440 may be cut off of each LED package holder 410, for example, at a location adjacent the inner contacts 422, or at a location adjacent the proximal end 415 of the housing 412.

Figure 6:
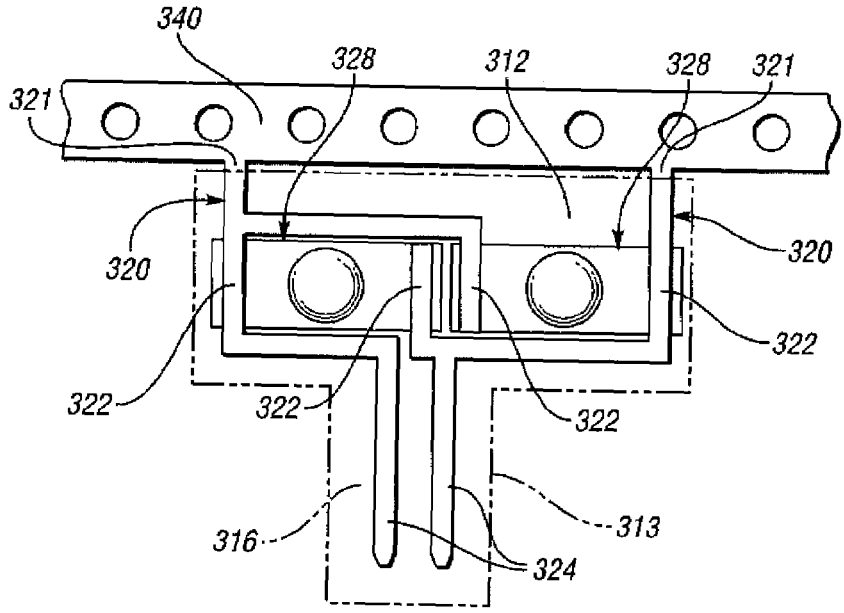
FIG. 6 is a schematic plan view of another lighting package embodying the principles of the present invention.

Referring now to FIG. 6, another embodiment of contact features 320 for use in an LED package holder with multiple LED packages is illustrated. The contact features 320 of FIG. 6 are connected at an end 321 by a continuous strip 340. As with the prior embodiments, the contact features 320 have inner contacts 322 and outer contacts 324. A phantom line 313 is shown to indicate schematically the approximate location wherein a housing 312 and connector shroud 316 would surround the contact features 320; the housing 312 and connector shroud 316 are shown only in phantom so that the contact features 320 may be illustrated more clearly. The contact features 320 are illustrated having four inner contacts 322, such that multiple LED packages 328 may be accommodated. In this embodiment, the left contact feature 320 engages the LED terminals on the left side of each LED 328, and the right contact feature 320 engages the LED terminals on the right side of each LED 328. It should be understood that the contact features 320 shown in FIG. 6 are merely one exemplary embodiment of contact features 320 capable of accommodating multiple LED packages 328, and they should not be viewed as limiting the present invention. For example, contact features 22 as shown in the previous embodiments could also accommodate multiple LED packages 328; one way this could occur is if the multiple LED packages 328 were provided in a tandem orientation instead of a side-by-side orientation as shown in FIG. 6.

As a person skilled in the art will readily appreciate, the above description is meant as an illustration of implementation of the principles this invention. This description is not intended to limit the scope or application of this invention in that the invention is susceptible to modification, variation and change, without departing from the spirit of this invention, as defined in the following claims.

We claim:

1. An LED package holder for holding and electrically connecting an LED package, the holder comprising:

a substantially flat housing having a longitudinal axis and a center opening defined therein;

a connector shroud extended from an edge of the housing along the longitudinal axis, the connector shroud having a cavity for receiving a connector operable to supply power to the LED package;

a plurality of unitarily formed contact features, each contact feature being retained by the housing and having an inner contact and an outer contact, the inner contact being configured to engage and contact LED electric terminals of an LED package received within the center opening, the outer contact extending into the cavity of the connector shroud and being configured to engage connector terminals when a connector is inserted into the connector shroud;

wherein the housing includes retainers at corners of the opening, the retainers being spaced apart from the inner contacts and defining a space therebetween for receiving and retaining an LED package.

2. The LED package holder of claim 1 wherein the shroud and housing are integrally formed.

3. The LED package holder of claim 1 wherein the shroud and housing are unitarily formed.

4. The LED package holder of claim 1, wherein the inner contacts extend into the center opening of the housing.

5. The LED package holder of claim 1, wherein the connector shroud comprises a latching feature.

6. The LED package holder of claim 5, wherein the latching feature of the connector shroud is configured to releasably retain a connector.

7. The LED package holder of claim 1, wherein the retainers are tabs.

8. An LED lighting package comprising:

at least one LED package having electric terminals;

an LED package holder comprising:

a substantially flat housing having a longitudinal axis and a center opening defined therein, the LED extended from an edge of the package being disposed in the center opening;

a connector shroud extended from an edge of the housing along the longitudinal axis the connector shroud defining a cavity for receiving a connector operable to supply power to the at least one LED package; and a plurality of unitarily formed contact features, each contact feature being retained by the housing, each contact feature having an inner contact and an outer contact, the inner contact engaging and contacting an electric terminal of the at least one LED package, the outer contact extending into the cavity of the connector shroud and being configured to contact connector terminals when a connector is inserted into the connector shroud;

wherein the housing includes retainers at corners of the opening, the retainers being spaced apart from the inner contacts and defining a space therebetween for receiving and retaining an LED package.

9. The light package of claim 8, wherein the inner contacts extend into the center opening of the housing.

10. The lighting package of claim 8, wherein the connector shroud comprises a latching feature, wherein the latching feature is configured to releasably retain a connector.

11. The lighting package of claim 10, wherein the latching feature is an opening in the connector shroud.

12. The lighting package of claim 8, wherein each contact feature is in electrical communication with at least one LED terminal, the electrical communication being free of solder material.

13. The lighting package of claim 8, further comprising a light projector disposed around the at least one LED package.

14. The lighting package of claim 8, further comprising a heat sink, the at least one LED package being disposed in thermal communication with the heat sink, and the housing being fastened to the heat sink.

* * * * *